United States Patent [19]

Dolan et al.

[11] Patent Number: 4,907,343

[45] Date of Patent: Mar. 13, 1990

[54] TERMINAL DEREELING APPARATUS

[75] Inventors: Jerome Dolan, West Dundee; Christopher Wanha, Naperville; Steven F. Wright, Glen Ellyn, all of Ill.

[73] Assignee: Molex Incorporated

[21] Appl. No.: 320,343

[22] Filed: Mar. 8, 1989

[51] Int. Cl.[4] ..... H01R 43/00

[52] U.S. Cl. ..... 29/707; 29/714; 29/753; 242/75.4; 242/75.47

[58] Field of Search ..... 29/564.6, 566.2, 706, 29/707, 753, 714, 715, 33 M, 564.4; 242/75.4, 75.47

[56] References Cited

U.S. PATENT DOCUMENTS

| | | | |
|---|---|---|---|
| 2,765,468 | 10/1956 | Cootes et al. | 29/566.2 |
| 3,101,765 | 8/1963 | Batcheller | 29/753 X |
| 4,025,999 | 5/1977 | Wolyn et al. | 29/753 |
| 4,437,232 | 3/1984 | Araki et al. | 29/740 |
| 4,598,471 | 7/1986 | Elsbree, Jr. et al. | 29/564.6 X |
| 4,654,952 | 4/1987 | Baldyga | 29/566.2 |

*Primary Examiner*—Carl E. Hall

*Attorney, Agent, or Firm*—Louis A. Hecht; Stephen Z. Weiss

[57] ABSTRACT

A terminal dereeling apparatus is provided for permitting efficient feeding of terminals into a terminating press. The terminal dereeling apparatus includes a terminal reel mount for permitting the unwinding of a terminal reel with substantially uniform tension throughout the unwinding. A take-up reel is provided in proximity to the terminal reel for efficiently winding the interleaf material disposed between adjacent layers of the terminal strip wound onto the terminal reel. A sensing apparatus, such as a photo-optical sensor is provided in spaced relationship to the terminating press for monitoring the feeding of terminals on the strip of terminals into the terminating press. The sensing apparatus is operative to interrupt the terminating process in response to a variation of the terminal feeding from a specified terminal feeding sequence.

10 Claims, 5 Drawing Sheets

TERMINAL DEREELING APPARATUS

BACKGROUND OF THE INVENTION

Electrical devices comprise arrays of insulated wires extending from one electrical connector to another. The opposed ends of each wire may have electrically conductive terminals mechanically and electrically mounted thereto. The terminals typically comprise a forward mating portion and a rearward wire engaging portion. The configuration of terminals varies widely depending upon the particular intended use for the terminal. However, the rearward wire engaging portion of most terminals is crimpable into electrical and mechanical engagement with the conductors of a wire. Some terminals are constructed to be mounted to an insulated wire, and the rearward wire engaging portions of such terminals are constructed to displace or pierce the insulation to achieve the required electrical connection with the conductor of the wire. With other terminals, a selected amount of insulation must be stripped from the end of the wire to enable the rearward end of the terminal to be crimped directly to the exposed conductor for achieving both mechanical and electrical connection therewith.

Electrical terminals typically are stamped and/or formed from a continuous strip of metal. A portion of the original strip is retained as a carrier strip for storing and transporting the terminals to the location at which the terminals are mounted to the wires. A plurality of such terminals and their carrier strip may be mounted to a reel for storage and shipment to a location where the crimp operation of terminating the terminals to the wires can be performed. Strips of terminals, however, are not well suited to being stored in tightly nested coiled relationship with one another. Thus, a continuous strip of interleaf material, such as paper or foam, may be wound with the strip of terminals to define alternate helical layers of interleaf and terminals. The interleaf functions to prevent adjacent wound layers of terminals from being entangled with one another and ensures that the terminals can be conveniently and reliably unwound from the reel. A typical reel of this type may be 24 inches in diameter and may contain thousands of terminals.

The strip of terminals typically will be delivered to a terminating press which is operative to crimp the rearward end of each terminal onto a wire and to simultaneously separate the terminal from its carrier strip. These crimping operations typically are carried out either manually or with an automated apparatus that is closely supervised by an operator. In a typical crimping operation a reel of terminals will be mounted to a non-rotatable shaft. A retainer plate may be mounted to the prior art shaft to retain the reel thereon. The retainer may incidentally exert a friction force against the rotating reel. However, the friction exerted against the reel by the prior art apparatus is not controllable.

The operator will feed the strip of terminals into a terminating press while taking care to manually separate the interleaf material from the terminals advancing into the press. Although most terminating presses index the strip of terminals automatically, the operator periodically must tear portions of accumulated interleaf material from the advancing strip for discarding into an appropriate trash receptacle. The operator also either feeds or oversees the feeding of wire into the terminating press. Depending upon the particular terminals and crimping process being employed, the wires may first be processed by removing a selected length of insulation therefrom.

The terminating press is operative to index the strip of terminals into a position where a terminal is aligned to receive the end of a processed wire. The wire end is urged into proximity to the terminal on this prior art terminating press, and the press is operated to crimp the terminal onto the wire. The terminating press completes its cyclical operation enabling the terminated wire to be removed therefrom and indexing the strip of terminals again to move the next sequential terminal into position to receive a wire.

As the number of terminals on the reel decreases, the operator employing the prior art apparatus may attempt to decrease the frictional force exerted on the reel by the retainer plate. In particular, the frictional forces exerted by the retainer plate on the reel should be fairly high when the reel is fully loaded to prevent overrunning of the reel. However, these high forces will make it difficult to pull terminals from the reel as the reel approaches its empty condition. Excessive dereeling tension can either break the carrier strip or prevent proper indexing. It is difficult for the operator of the prior art apparatus to precisely predict the required variations in the frictional forces on the reel. Therefore, accurate and timely adjustments to the retainer plate of the prior art apparatus are unlikely.

The prior art has included various attempts to reduce the amount of operator work and supervision required for harnessing work. However, these prior art attempts at automation have not been completely successful in replacing the various steps that had been carried out by the human operator. For example, the prior art attempts to automate the terminal dereeling and crimp work have not adequately accounted for the interleaf material that is required to prevent entanglement of terminals on the reel. In particular, the interleaf material would have a tendency to entangle with, jam and damage the terminating press.

These prior art attempts at automation also could not account for the amount of tension force required to pull the terminal strip from the reel. In particular, the prior art attempts at automation would result in too low a friction force on a nearly full reel resulting in overrunning of the reel and excessive feeding of terminals into a position where the terminals could be damaged. Alternatively, the prior art automated terminal feeding apparatus would result in excessively high tension to pull the strip of terminals from a nearly empty reel, thereby creating the possibility of damage to the strip before all of the terminals thereon have been properly mounted to wire leads, and/or improper indexing of the strip.

The operator of the less automated prior art devices fullfilled an important function of almost immediately identifying jams or other malfunctions such as multiple terminations to a single wire or no terminations to a wire. The operator of the typical prior art apparatus could immediately stop operation of the apparatus, correct the problem and recommence the termination procedure. However, the more fully automated prior art devices did not adequately replace this important human operator function. Thus, the prior art automated terminal feed apparatus would continue to feed terminals into a crimp press in spite of a jam thereby yielding multiple terminations. These plural terminations could damage the expensive tooling on the terminating press and would result in extensive costly down-time.

Typical examples of prior art attempts to automate the terminal feeding and harnessing work include: U.S. Pat No. 4,043,032, which issued to Spangler on Aug. 23, 1977; U.S. Pat. No. 4,489,871, which issued to Bakermans et al. on Dec. 25, 1984; U.S. Pat. No. 4,691,437, which issued to Vaglini on Sept. 8, 1987; U.S. Pat. No. 4,403,407, which issued to Mazzola on Sept. 13, 1983; U.S. Pat. No. 4,631,823, which issued to Collier on Dec. 30, 1986; U.S. Pat. No. 3,548,479, which issued to Netta on Dec. 22, 1970; and, U.S. Pat. No. 4,718,160, which issued to Bulanda on Jan. 12, 1988.

In view of the above, it is an object of the subject invention to provide an automated terminal dereeling apparatus.

It is another object of the subject invention to provide a terminal dereeling apparatus that can be used with a terminal crimp press, a wire processor and/or other apparatus for performing harness work on a wire.

It is a further object of the subject invention to provide a terminal dereeling apparatus with means for accumulating the interleaf strip disposed between adjacent coils of the terminals and carrier strip on the reel.

An additional object of the subject invention is to provide a terminal dereeling apparatus that is operative to smoothly and continuously feed terminals from the beginning to the ending positions of the strip of terminals wound onto the reel.

Yet another object of the subject invention is to provide a terminal dereeling apparatus which is operative to sense the proper indexing of terminals into the terminating press.

It is still an additional object of the subject invention to provide a terminal dereeling apparatus which is operative to discontinue wire processing and terminal crimping in response to a sensed improper indexing of terminals into the terminating press.

SUMMARY OF THE INVENTION

The subject invention is directed to a dereeling apparatus for dereeling a continuous strip of terminals, and enabling efficient feeding of the strip of terminals into a prior art terminating press. The prior art terminating press typically is employed in combination with a prior art wire processing machine which is operative to automatically process and feed wire into the terminating press. The typical known combination of a terminating press and wire processor is operative to sequentially index terminals from a strip of terminals into position to receive the wire. The wire is processed by stripping and/or cutting the wire and feeding the end of the wire into the terminating press. The typical terminating press is operative to pneumatically or electrically sense the presence of the wire therein. In response to the sensed presence of wire, the terminating press will complete its cycle by crimping or otherwise connecting the terminal to the end of the wire. The terminating press will then return to its initial position enabling the terminated wire lead to be removed and replaced by the next wire lead. The particular operation and configuration of the prior art terminating press and wire processor may vary somewhat from the above described typical construction. The terminal dereeling apparatus described herein is intended to be compatible with any of a plurality of combinations of available prior art terminating presses and wire processors.

The terminal dereeling apparatus of the subject invention may comprise a rotatable reel mounting means onto which the reel of terminals is mounted. The rotatable reel mounting means of the dereeling apparatus may comprise a shaft rotatably mounted to a spindle bearing. Thus, the shaft is rotatable with the reel. The reel mounting means of the subject apparatus may further comprise a spring plate against which the hub of the reel of terminals is mountable. The spring plate is urged axially against the reel mounted onto the rotatable shaft. The reel is lockable into position on the rotatable shaft such that the spring plate exerts an axial force against the hub of the reel of terminals. The axial braking force exerted by the spring plate against the hub of the reel and the inherent operation of the spindle bearing cooperate to enable efficient feeding of the terminals from the reel both for a fully loaded reel and a nearly empty reel. In particular, the forces exerted by the spring plate against the hub of the reel are operative to prevent overrotation of the nearly full reel in response to tension forces exerted on the strip of terminals. Similarly, the spindle bearing is operative to permit lower tension forces on the strip of terminals being fed from the nearly empty reel. As a result of this combination it is unnecessary to periodically adjust the mounting forces on the reel as the strip of terminals is unwound.

The terminal dereeling apparatus is operative to feed the strip of terminals in a selected direction relative to the reel. The apparatus may further comprise a take-up means for accumulating the interleaf material. The take-up means may be disposed relative to the terminal reel such that the interleaf material is removed from the terminal reel along a path that is angularly displaced from the path followed by the strip of terminals. The take-up means may comprise a rotatably driven reel. The take-up reel may be powered by a DC motor having means for ensuring that the take-up reel does not drive the terminal reel, but rather ensuring that the take-up reel merely accommodates the slack interleaf material produced as the terminals are indexed into the terminating press.

The dereeling apparatus may further comprise a carrier strip guide that ma be adjustably positionable relative to the terminating press. The carrier strip guide includes an entry which will accommodate the approach of the strip of terminals from any of a plurality of different directions, thereby accounting for different angular alignments of the approaching carrier strip as the terminal reel gradually changes from its full to its empty condition.

The apparatus further comprises sensing means for sensing the presence of a terminal in proximity to the terminating press. The sensing means will be operative to generate a signal in response to a sensed improper indexing of terminals into the terminating press. For example, the signal generated by the sensing means may be operative to terminate the operation of the prior art wire processor and/or the terminating press.

The sensing means may comprise photo-optical means for sensing the presence and/or absence of a terminal in a specified position relative to the terminating press. For example, in a normal operation the photo-optical means may sequentially sense the absence of a terminal followed by the presence of a terminal. Upon a failure to sense this specified sequence or timing, the photo-optical means will generate a signal to stop the wire processor and/or the terminating press, thereby preventing continued indexing. This avoids defective terminations and the potential for damage to the expensive tooling on the terminating press. A control module may be operatively connected to the photo-optical means and to the wire processor such that the wire processor may be switched to an off mode by the control module in response to a sensed improper indexing.

DESCRIPTION OF THE PREFERRED EMBODIMENT

Figure 1:
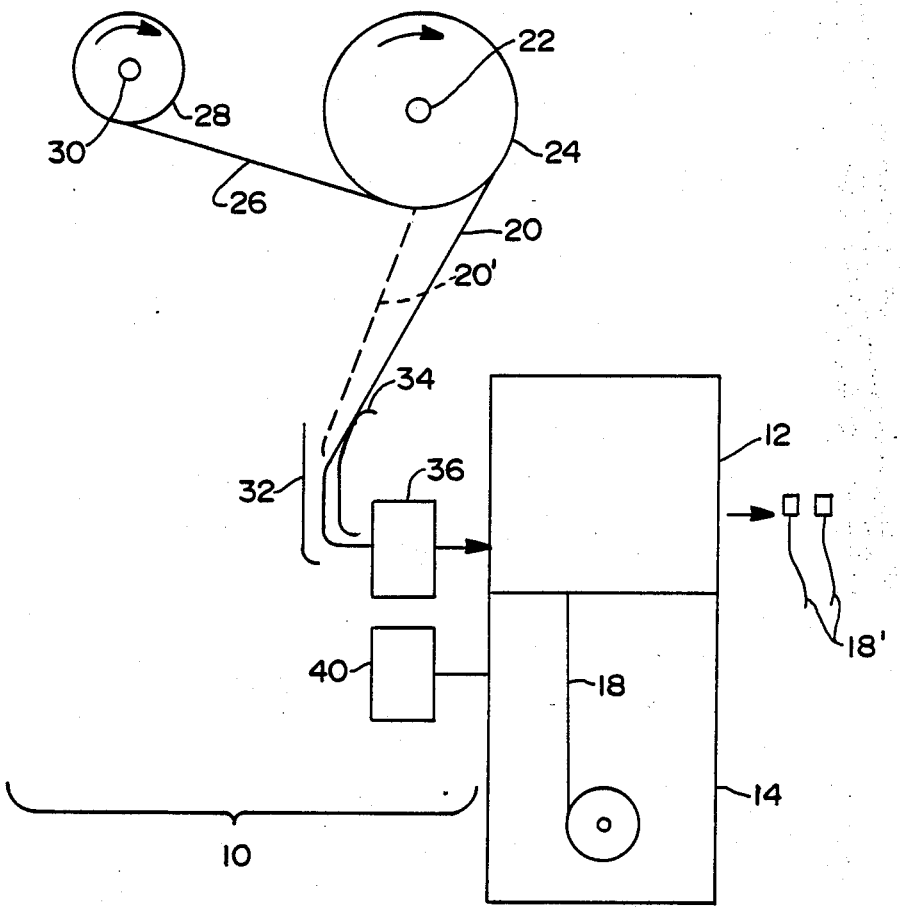
FIG. 1 is a schematic illustration of the terminal dereeling apparatus of the subject invention.
Figure 2:
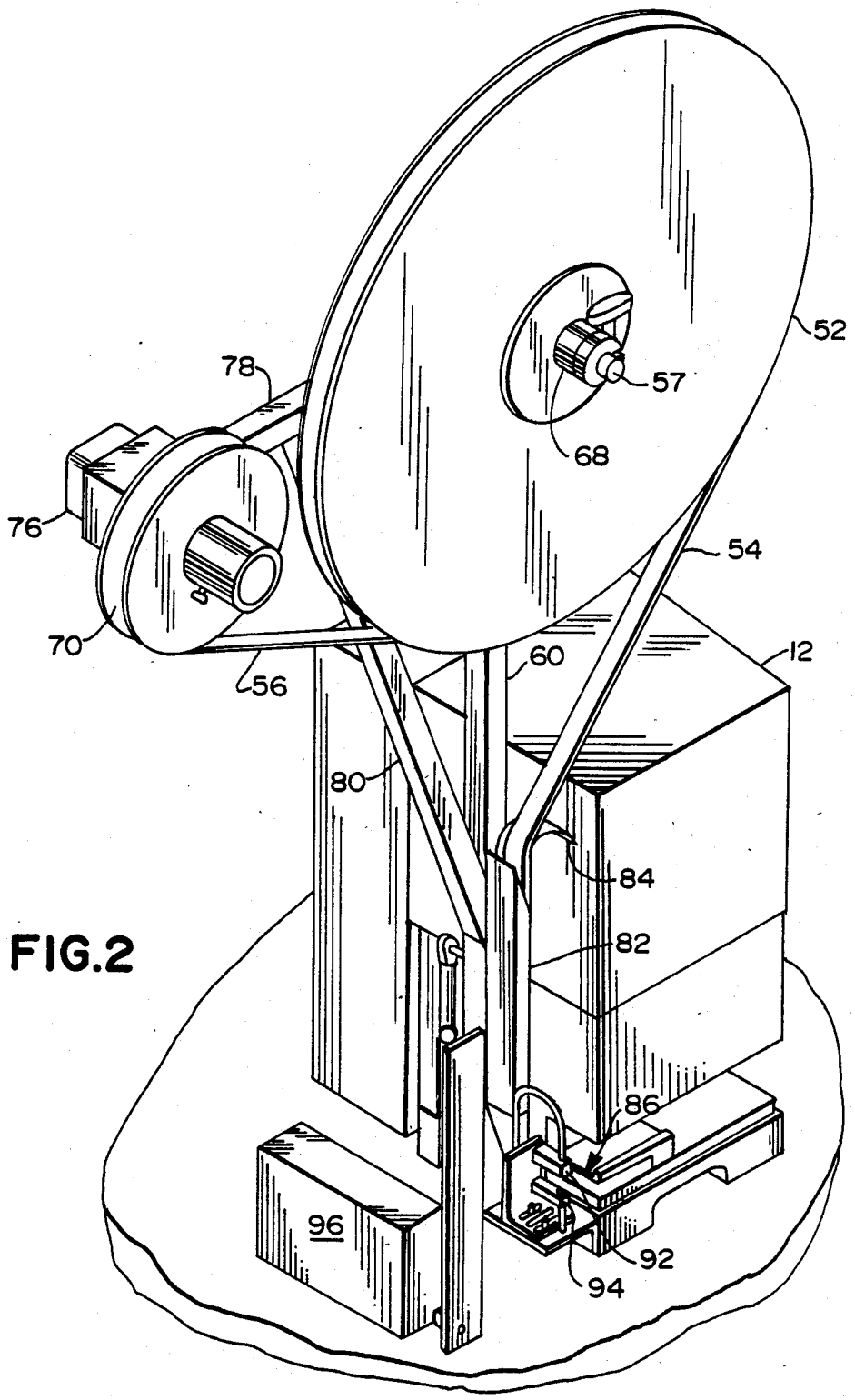
FIG. 2 is a perspective view of the terminal dereeling apparatus mounted to a terminating press.

The terminal dereeling apparatus of the subject invention is identified generally by the numeral 10 in the schematic illustration of FIG. 1. The terminal dereeling apparatus 10 is intended for use with a prior art terminating press 12 and a prior art wire processor 14. The general schematic illustrations of the terminating press 12 and the wire processor 14 are intended to indicate that the terminal dereeling apparatus 10 can be employed with any of the many available prior art or yet to be developed terminating presses and wire processors.

The wire processor 14 is operative to present the end of a wire 18 to the terminating press 12. In certain applications, the wire processor 14 will strip a selected length of insulation from the conductor of the wire 18 prior to presentation of the wire 18 to the terminating press 12. The wire processor 14 is further operative to cut the wire 18 at a preselected length. Examples of prior art wire processors 14 include the KOMAX® Model 33 and Model 40S distributed by Komax Corporation of Buffalo Grove, Ill., and the ARTOS® CS-34 and C39 manufactured by Artos Engineering Company of New Berlin, Wis.

The terminating press 12 includes means for indexing the carrier strip of a strip of terminals identified generally by the numeral 20 in FIG. 1. The distance by which the strip 20 is advanced during each indexing operation of the terminating press 12 is dependent upon the pitch between adjacent terminals on the strip 20. The indexing distance is selected to sequentially present each terminal on the strip 20 to a position on the terminating press 12 for crimping each terminal to the end of the wire 18 delivered by the wire processor 14.

The prior art wire processor 14 includes sensing means for sensing the presence of the end of the wire 18 in a position adjacent the terminating press 12 to have a terminal from the strip 20 crimped thereto. The sensed presence of the wire 18 will initiate a cycle of the terminating press 12 wherein the tooling of the terminating press 12 crimps portions of the properly positioned terminal onto the end of the wire 18. If the terminating press 12 is operating properly, the terminated wire 18' will be moved away from the terminating press 12, and the next terminal will be indexed into position for receiving the end of the wire 18. However, as noted above, the terminating press 12 employed in prior art automated systems are subject to malfunction. In particular, the terminating press 12 may complete its crimping cycle in response to the sensed presence of the wire 18 even though the next sequential terminal has not properly been indexed into position. The result of this particular malfunction will be the production of a length of wire 18 with no terminal. Other malfunctions may include plural terminations to a single length of wire 18 due to a failure of the terminating press 12 to move the properly terminated wire 18 out of the terminating press 12. As noted above, these types of malfunctions can damage the expensive tooling incorporated into the terminating press 12. Among the many reasons for these malfunctions are the difficulty of controlling the tension on the strip of terminals 20 and the difficulty of controlling the paper or foam interleaf material that typically is employed with the strip of terminals 20.

The terminal dereeling apparatus 10 of the subject invention avoids the above described malfunctions in the terminating press 12. As shown generally in FIG. 1 and in greater detail below, the terminal dereeling apparatus 10 comprises a reel mounting means 22 for rotatably receiving a reel 24 having an elongated strip of terminals 20 mounted thereon. The reel mounting means 22 is operative to permit the dereeling of the strip of terminals 20 in response to approximately uniform tension both for the fully loaded condition of the reel 24, as depicted schematically in FIG. 1 and for the nearly empty condition of the reel 24 as depicted in broken lines by the numeral 20'. The ability to substantially uniformly control the tension required to unreel the strip of terminals 20, 20' both in the fully loaded and nearly empty condition of the reel 24 minimizes the amount of operator time required for supervision of the terminal dereeling system 10 and avoids a cause of malfunction within the terminating press 12. As depicted herein the reel mounting means 22 is disposed above the terminating press 12. However, this illustrated orientation is only one of many possible positions for the reel mounting means 22. In other embodiments an identical reel mounting means will be below the terminating press 12 or generally at the same elevation as the terminating press 12.

The reel 24 is wound with a strip of interleaf material 26 which may be paper, foam or other flexible material for preventing terminals on adjacent coils of the strip 20 from being inadvertently snagged with one another. As noted above, the interleaf material 26 had been a cause of problems with prior art attempts to automate the delivery of terminals to the terminating press 12. The terminal dereeling apparatus 10 illustrated in FIG. 1 includes a take-up reel 28 mounted to a rotatably driven shaft 30. The take-up reel 28 and rotatably driven shaft 30 are disposed in spaced relationship to the reel 24 and are operative to take up the interleaf material 26 being unwound from the reel 24. The take-up reel 28 and the rotatably driven shaft 30 may be disposed such that the interleaf material 26 and the terminal strip 20 angularly diverge from one another at a selected location along their respective paths. The rotatably driven shaft 30 may comprise a power means for ensuring that slack in the interleaf material 26 is taken up, but preventing the forces exerted on the interleaf material 26 from controlling the rotation of the reel 24.

The strip of terminals 20 proceeds from the reel 24 to a carrier strip guide 32. The carrier strip guide 32 includes a flared entry 34 to insure that the strip of terminals 20 will be properly fed into the guide 32 for different angular alignments of the strip of terminals 20 that will occur as the number of terminals on the reel 24 is depleted.

The carrier strip guide 32 is configured to guide the strip of terminals 20 into the sensing means 36. The sensing means 36 is operative to sense the presence and/or absence of a terminal on the strip 20 in a specified location therein. The operative components of the sensing means 36 are spaced from the crimping tools in the terminating press 12 a distance equal to some selected multiple of the pitch between terminals on the strip 20. In one preferred embodiment, as explained further below, the sensing means 36 defines photo-optical sensing means which comprises a light source and a photodetector disposed respectively on opposite sides of the strip 20 and in alignment with terminals thereon. If the terminating press is operating properly and indexing the strip 20 an amount equal to the pitch between adjacent terminals, then the sensing means 36 will sequentially sense the presence of a terminal followed by the absence of a terminal and the appearance of the next terminal within a preset time period. In the preferred embodiment described and illustrated further below, a terminal on the strip 20 will block the light from the light source when a downstream terminal is in position for being crimped onto the wire 18. During the indexing, however, the light from the light source will pass to the photodetector. Light will again be blocked when the next downstream terminal is in proper alignment to receive a wire 18.

If the specified pattern of signals sensed by the sensing means 36 is not received, the apparatus 10 will generate a stop signal. More particularly, the terminal dereeling apparatus 10 comprises a control module 40 which is operatively connected to both the sensing means 36 and the wire processor 14. The control module 40 will terminate the operation of the wire processor 14 upon receipt of a signal from the sensing means 36 corresponding to a break in the specified sequence of signals. The control module 14 may also be operative to generate an operator signal indicating an operational problem that must be corrected by the technician supervising the operation of a plurality of the terminal dereeling apparatus. As noted above, the feeding of wire from the wire processor 14 generates the signals which cause the terminating press 12 to operate. As a result, the shutting down of the wire processor 14 by the control module 40 will simultaneously shut down the terminating press 12.

FIGS. 2 through 5 illustrate one preferred embodiment in greater detail. As shown most clearly in FIG. 2, the reel 52 of approximately 24 inches in diameter is provided with a helical strip of terminals 54 interleafed with a paper or foam strip 56. The terminal reel 52 is mounted to shaft 57 rotatable in a spindle bearing 58 which is mounted to a support 60. A back plate and a pressure plate 62 and 64 respectively are mounted to the support 60 and substantially surround the rotatable shaft 57. In particular, the pressure plate 64 is disposed in spaced relationship to the back plate 62 by an array of coil springs 66 extending in generally axial directions parallel to the rotatable shaft 57. The springs 66 exert a predetermined force between the back plate 62 and pressure plate 64. The terminal reel 52 is mounted over the rotatable shaft 57 with sufficient force to urge the pressure plate 64 against the action of the coil spring 66 and toward the back plate 62. The reel 52 is then locked into position on the rotatable shaft 57 by the locking means 68. In this condition the springs 66 will cause the pressure plate 64 to exert a predetermined force against the hub of the reel 52. The cooperation between the shaft 57 freely rotatable in the spindle bearing 58 and the forces exerted by the spring 66 against the pressure plate 64 will enable the strip of terminals 54 to be unwound from the reel 52 with a nearly uniform tensile force for both full and empty loading conditions of the reel 52.

An adjustable take-up reel 70 is mounted in fixed relationship to the terminal reel 52 and includes a hub 72 which is constructed to receive the strip of interleaf material 56 therein and to enable the interleaf material 56 to be wound thereabout. For example, the hub 72 of the take-up reel 70 may include a slot dimensioned to receive the initial portion of the interleaf material 56 and permit subsequent winding of the interleaf material 56 about the hub 72. Rotation of the adjustable take-up reel 70 is controlled by a DC motor 76 which rotates the take-up reel 70 only to take up slack interleaf material. Thus, the DC motor 76 and the take-up reel 70 will not exert sufficient force to drive the terminal reel 52 faster than the speed dictated by the terminating press 12. The take-up reel 70 and the DC motor 76 are rigidly mounted relative to the terminal reel 52 by brackets 78 and 80.

Figure 3:
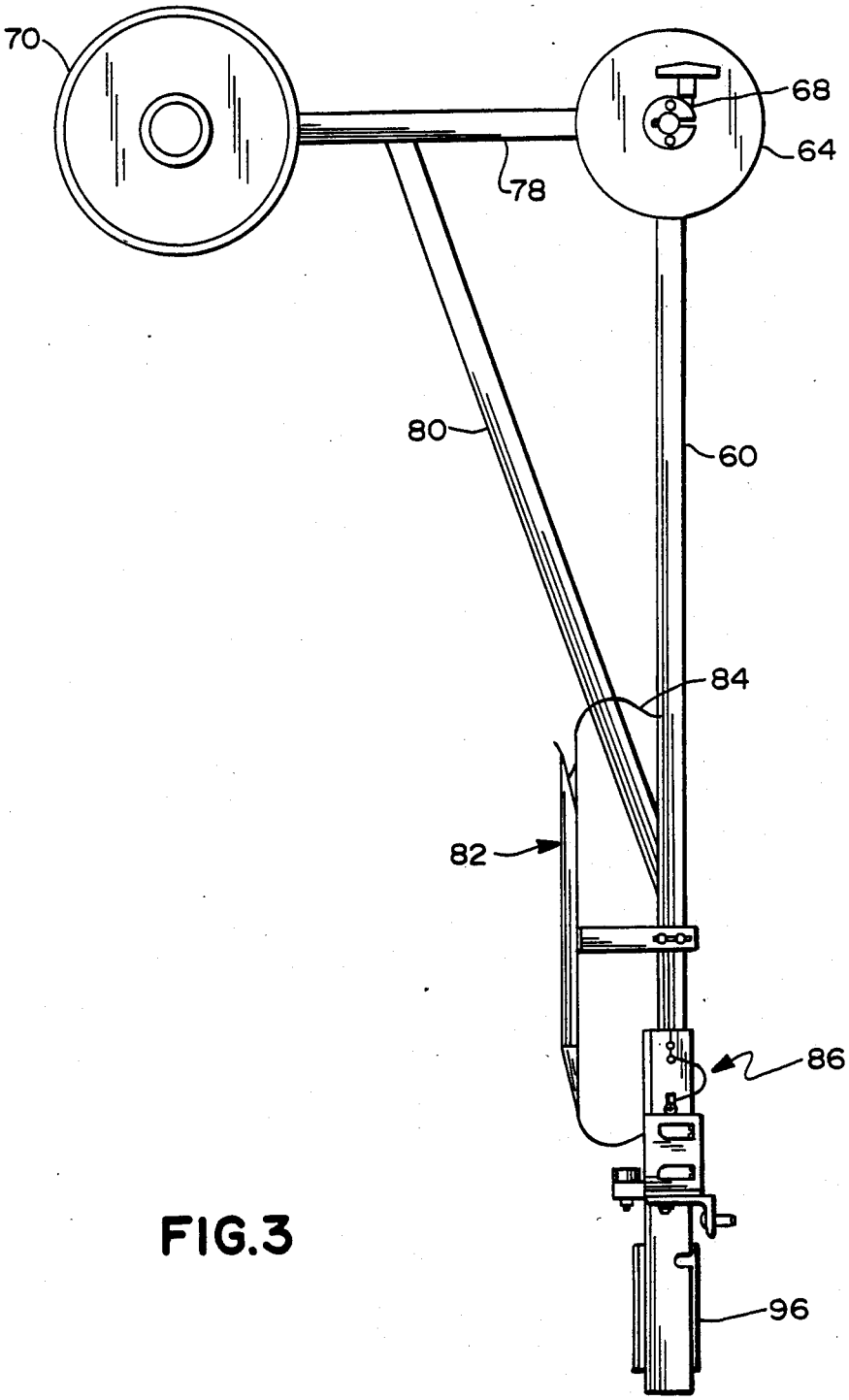
FIG. 3 is a side elevational view of the terminal dereeling apparatus.
Figure 4:
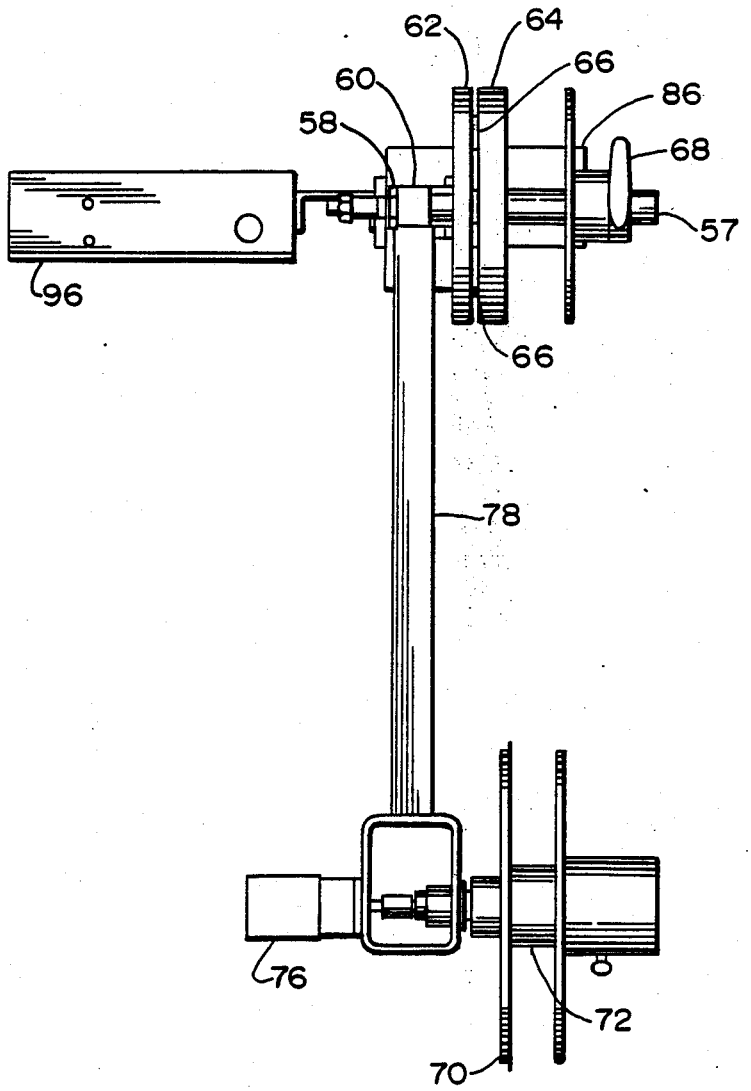
FIG. 4 is a top plan view of the terminal dereeling apparatus shown in FIG. 3.
Figure 5:
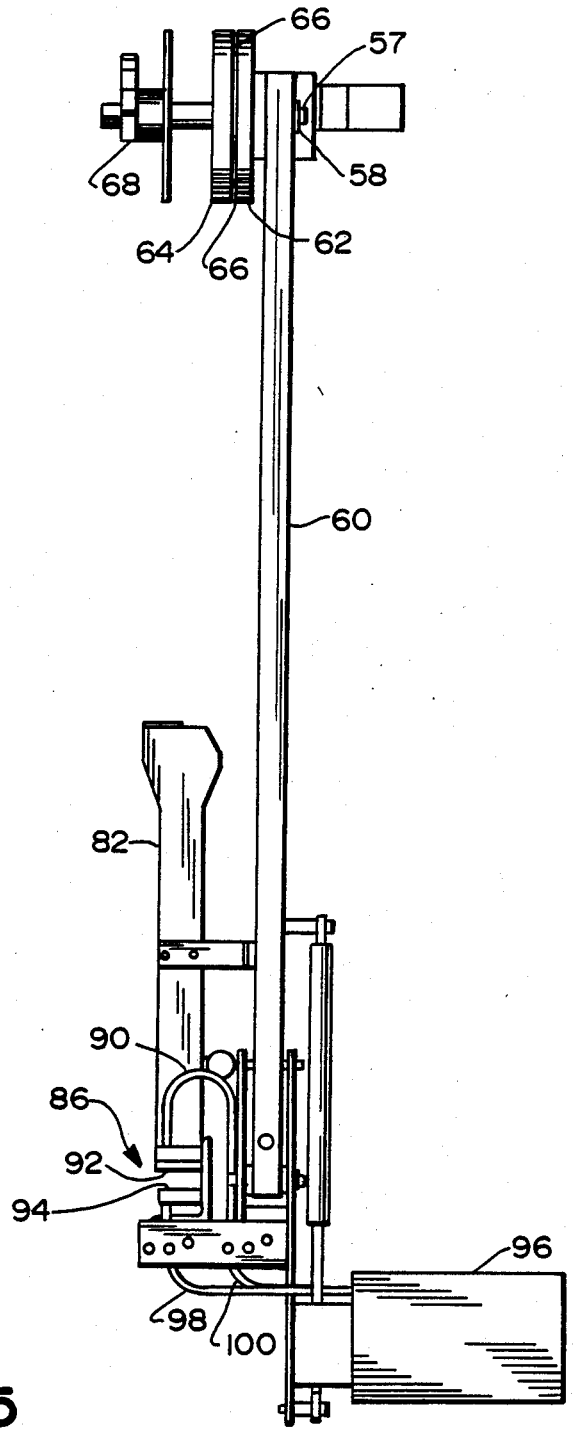
FIG. 5 is a front elevational view of the terminal dereeling apparatus shown in FIGS. 3 and 4.

The strip of terminals 54 is guided toward the operative portions of the terminating press 12 by the carrier strip guide 82 having a flared entry portion 84 as shown most clearly in FIG. 3. The guide 82 is operative to guide the strip of terminals 54 into a photo-optical sensing apparatus 86. The sensing apparatus 86 directs a light signal through an optical fiber 90 which terminates at end location 92. A photodetector 94 is disposed in alignment with the end 92 of the optical fiber 90. The photodetector 94 and the end 92 of the optical fiber 90 are disposed at a distance from the terminating tooling in the terminating press 12 equal to a whole number multiple of the pitch between terminals on the strip 54. Thus, when a downstream terminal is in alignment with the tooling of the terminating press 12, a selected upstream terminal will be disposed intermediate the photodetector 94 and the end 92 of the optical fiber 90, thereby preventing the photodetector 94 from receiving an optical signal. However, optical signals will be received by the photodetector 94 as the strip of terminals 54 is indexing.

A control module 96 is connected to the sensing apparatus 86 by cables 98 and 100. The control module 96 is operative to generate a signal in response to a variation in the specified timing and sequence of signals received by the photodetector 94. In particular, a sensed variation in the specified pattern of optical signals received by the photodetector 94 will be indicative of a malfunction in the system. A signal generated by the control module 96 will be operative to interrupt the wire processor, which in turn will be operative to interrupt the terminating press 12. Thus, the entire system will be interrupted, enabling the jam or other malfunction to be corrected before any significant damage to the system could have occurred.

While the invention has been described with respect to a preferred embodiment, it is understood that variations can be made without departing from the scope of the invention as defined by the appended claims. In particular, it is to be understood that the terminal dereeling apparatus is not necessarily integral with a terminating press or wire processor and can be used in various forms with different terminal presses and wire processors. It is further to be understood that the relative positions of the terminal reel, the take-up reel and the terminal sensing means can be varied relative to one another from the positions illustrated and described above.

We claim:

1. A terminal dereeling apparatus for delivering a carrier strip with terminals integral therewith into a terminating press, said carrier strip being wound onto a terminal reel with an interleaf material disposed intermediate adjacent layers of the carrier strip on the terminal reel, said terminal dereeling apparatus comprising:

terminal reel mounting means in proximity to the terminating press for rotatably receiving the terminal reel thereon including a rotatable shaft onto which said terminal reel is rotatably mountable and a back plate aligned generally orthogonal to the rotatable shaft, a pressure plate surrounding the rotatable shaft, said pressure plate being movable relative to said back plate, spring means intermediate said back plate and said pressure plate for urging said pressure plate away from said back plate, whereby said pressure plate is operative to exert a predetermined pressure against the terminal reel mounted on the rotatable shaft;

take-up means in proximity to said terminal reel mounting means for taking up the interleaf material unwound from said terminal reel; and terminal sensing means in proximity to said terminating press for sensing the presence of terminals on the carrier strip, said sensing means being operative to interrupt the terminating press in response to selected sensed patterns of terminals as said carrier strip is delivered to said terminating press.

2. An apparatus as in claim 1 wherein the terminal reel mounting means further comprises locking means for locking said terminal reel onto said rotatable shaft and against the forces exerted on the terminal reel by the pressure plate.

3. An apparatus as in claim 2 wherein said terminal reel mounting means comprises a spindle bearing, said rotatable shaft being rotatably mounted to said spindle bearing.

4. An apparatus as in claim 1 wherein the take-up means comprises a rotatably driven take-up reel.

5. An apparatus as in claim 4 wherein said take-up means further comprises motor means for rotatably driving the take-up reel such that said take-up reel accumulates slack interleaf material unwound from said terminal reel.

6. An apparatus as in claim 5 wherein the motor means comprises a DC motor.

7. An apparatus as in claim 5 wherein the sensing means comprises a light emitter and a photodetector disposed on opposite respective sides of the carrier strip and at a selected distance from the terminating press.

8. An apparatus as in claim 7 wherein the terminals are disposed along the carrier strip at substantially uniform spacings defining a terminal pitch, the distance between the sensing means and the terminating press being a whole number multiple of the terminal pitch such that a terminal will be disposed between the photodetector and the light source of said sensing means when another terminal on said carrier strip is disposed in proximity to the terminating press.

9. An apparatus as in claim 1 wherein the terminating press is operatively connected to a wire processor for feeding wire into the terminating press, said apparatus comprising control means operatively connected to said wire processor and to said sensing means for interrupting the processing of wire by the wire processor in response to selected sensed conditions by said sensing means.

10. A terminal dereeling apparatus for permitting efficient indexing of a carrier strip to a terminating press, said carrier strip comprising a plurality of terminals integral therewith and being wound onto a terminal reel with an interleaf material disposed intermediate adjacent layers of the carrier strip on the terminal reel, said terminal dereeling apparatus comprising:

terminal reel mounting means disposed in fixed relationship to the terminating press, said terminal reel mounting means comprising a spindle bearing and a shaft rotatably mounted in said spindle bearing, said shaft being dimensioned for receiving the terminal reel thereon, and pressure plate means for exerting braking forces against the terminal reel;

a rotatably driven take-up reel means for taking up slack interleaf material unwound from said terminal reel;

photo-optical means mounted in fixed spaced relationship to the terminating press for sensing the presence of terminals on said carrier strip as said carrier strip is indexed toward said terminating press including a light source disposed on one side of said carrier strip and a photodetector disposed in alignment with said light source and on the opposed side of said carrier strip, said light source and said photodetector being disposed relative to said carrier strip for sensing the presence of the terminals mounted on said carrier strip; and control means operatively connected to said photo-optical means and said terminating press for interrupting said terminating press in response to a pattern of terminals sensed by said photo-optical means which differs from a specified pattern of sensed terminals.

* * * * *